US006259069B1

(12) United States Patent
Schotten et al.

(10) Patent No.: US 6,259,069 B1
(45) Date of Patent: Jul. 10, 2001

(54) APPARATUS FOR DETECTING THE PRESENCE OF A COOKING VESSEL

(75) Inventors: Henno Schotten, Ratzenried; Norbert Mörsch, Wangen; Jörg Meyer, Ratzenried, all of (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 0 days.

(21) Appl. No.: 09/666,636

(22) Filed: Sep. 21, 2000

(51) Int. Cl.[7] ..... H05B 3/68
(52) U.S. Cl. ..... 219/447.1; 219/518
(58) Field of Search ..... 219/446.1, 447.1, 219/518, 620, 621, 624

(56) References Cited

U.S. PATENT DOCUMENTS

| | | | | |
|---|---|---|---|---|
| 4,334,135 | * | 6/1982 | Smith | 219/518 |
| 5,296,684 | * | 3/1994 | Essig et al. | 219/518 |
| 5,424,512 | * | 6/1995 | Turetta et al. | 219/447.1 |
| 5,491,423 | * | 2/1996 | Turetta | 219/447.1 |
| 5,893,996 | * | 4/1999 | Gross et al. | 219/447.1 |
| 5,977,523 | * | 11/1999 | Scott | 219/447.1 |

FOREIGN PATENT DOCUMENTS

| | | |
|---|---|---|
| 3734157 A1 | 4/1991 | (DE) . |
| 196 46 826 A1 | 8/1997 | (DE) . |
| 0 553 425 B1 | 8/1993 | (EP) . |
| 0 788 293 A2 | 8/1997 | (EP) . |

* cited by examiner

*Primary Examiner*—Sang Paik
(74) *Attorney, Agent, or Firm*—Scully, Scott, Murphy & Presser

(57) ABSTRACT

An apparatus for detecting the presence and/or the size of a cooking vessel (6) on an electrically heatable hotplate, having a resistance heating element (1) which is disposed under the hotplate and which is connected to an electrical heating voltage supply, wherein the resistance heating element (1) is used as a capacitive sensor for pot detection. The capacitance of the resistance heating element (1) in relation to a reference potential, preferably earth, is connected into an electrical resonant circuit whose resonance frequency can be detected by an evaluation unit, whereby it is possible to ascertain the presence and/or the size of a cooking vessel (6) on the hotplate. The resistance heating element (1) is connected to the heating voltage supply by way of electrical switching means, preferably inductors (DR1, DR2), and is connected into the resonant circuit by way of a further electrical switching means, preferably a separating capacitor (CN).

10 Claims, 2 Drawing Sheets

APPARATUS FOR DETECTING THE PRESENCE OF A COOKING VESSEL

BACKGROUND OF THE INVENTION

1. Field of the Invention

The invention concerns an apparatus for detecting the presence and/or the size of a cooking vessel on an electrically heated hotplate or hob, which includes a resistance heating element which is disposed under the hotplate or hob and which is connected to an electrical heating voltage supply.

2. Discussion of the Prior Art

Pot detection apparatuses of that kind are widely known. Thus, EP 0 788 293 A1 describes an electrical radiant heating body with a pot detection means, which uses an inductive sensor in the form of a loop of thick wire, which is disposed in the air space between the heating conductor and the hotplate and serves as an inductive element of a resonant circuit whose resonance frequency is displaced when a pot is placed on the hotplate by virtue of a change in the inductance of the wire loop.

DE 196 46 826 A1 discloses a pot detection arrangement using capacitive sensors which are formed by a plurality of electrodes, which are also disposed between the heating conductor and the hotplate, and with which an electrical resonance circuit is driven. When a pot is placed on the hotplate, the capacitance of those sensors changes, and therewith also the resonance frequency of the resonant circuit.

DE 39 34 157 A1 describes a cooking tray or hob in which a plurality of sensors are disposed therein for the purposes of detecting the surface area occupied by cooking vessels of different sizes. The sensors used are ultrasonic sensors or capacitive sensors, for measuring the heat flux or for measuring the radiation issuing from the heating means and the hotplate.

The pot detection apparatus disclosed in EP 0 553 425 B1 uses a sensor in the form of an electrical conductor which forms an open loop and which is disposed between the heating element and the hotplate. When a pot is put onto the hotplate, the conductivity of that sensor changes.

The described state of the art, for pot detection purposes, always requires special sensors which are arranged in the cooking tray or between the heating conductor and the hotplate. Those sensors must be designed in such a way that they can withstand the high temperatures of the cooking zone. In addition, steps must be taken to ensure that those sensors do not interfere with the electrical insulation system of heating means-cooking pot. In addition, a pot detection apparatus with such sensors is not suitable for use in relation to hotplates, against the underside of which the electrical resistance heating bears directly (by way of an insulating layer), without the presence there of an intermediate air gap in which those sensors could be disposed.

SUMMARY OF THE INVENTION

Based on that state of the art, the object of the present invention is to implement a pot detection apparatus of a simple structure, which does not suffer from the above-indicated disadvantages.

That object is attained by an apparatus for pot detection, in which the resistance heating element is utilized as a capacitive sensor for pot detection.

Using the resistance heating element itself as a capacitive sensor for pot detection means that there is no need for an additional sensor which would have to be disposed in the hotplate-resistance heating system. This therefore excludes from the outset any adverse effect in relation to the electrical insulating system consisting of the heating arrangement and the cooking pot. In addition, there is also no need for an air gap between the heating element and the hotplate, and the heating element can be brought into direct contact with the hotplate. In addition, the expenditure involved in securing an additional pot detection sensor in position and wiring it into circuit is eliminated.

Preferably, the invention is such that the capacitance of the resistance heating element, in relation to a reference potential, preferably earth, is connected into an electrical resonant circuit, that the resonance frequency of that resonant circuit can be detected by an evaluation unit, and that in that way the presence and/or the size of a cooking vessel on the hotplate can be ascertained.

The resistance heating element is preferably connected to the heating voltage supply by way of electrical switching means, preferably inductors, and is connected into the resonant circuit by way of a further electrical switching means, preferably a separating capacitor. In an advantageous embodiment the resonant circuit contains the resistance heating element, the separating capacitor, an inductive element, preferably a coil, and the reference potential. In addition it is preferably provided that a capacitor is connected between the electrical terminals of the resistance heating element.

In the case of multi-circuit hotplates, a development of the invention provides that it is possible to use a plurality of resonant circuits, wherein the respective heating element forming the corresponding heating circuit is used as a capacitive sensor for pot detection.

It is further provided that the hotplate comprises ceramic or glass ceramic, that the resistance heating element is a radiant heating body, a foil heating element or a heating path or layer disposed on a support, and that the resistance heating element has line windings or a flat ribbon or band.

The use of a flat ribbon or band heating body, a foil heating element, a heating layer or a heating path is particularly desirable for the invention as such a flat heating element is particularly well suited as a capacitive element.

In a preferred embodiment of the invention, by virtue of the value of or by virtue of the change in the resonance frequency of the resonant circuit, the size of a cooking vessel which is standing on the hotplate or the degree to which the hotplate is covered by a cooking vessel, can be detected by the evaluation unit.

It should be noted here that the invention concerns an apparatus for pot detection, with which it is not only possible to ascertain whether a cooking vessel is or is not standing on the hotplate, but also how much of the surface area of the hotplate is covered by a cooking vessel, whether a large or a small cooking vessel is standing on the hotplate, and whether it is standing thereon at a central position or in a laterally displaced position.

BRIEF DESCRIPTION OF THE DRAWINGS

An embodiment of the invention will be described in greater detail hereinafter with reference to the drawings, without the invention being limited to such an embodiment.

In the drawings.

DETAILED DESCRIPTION OF PREFERRED EMBODIMENTS

Figure 1:
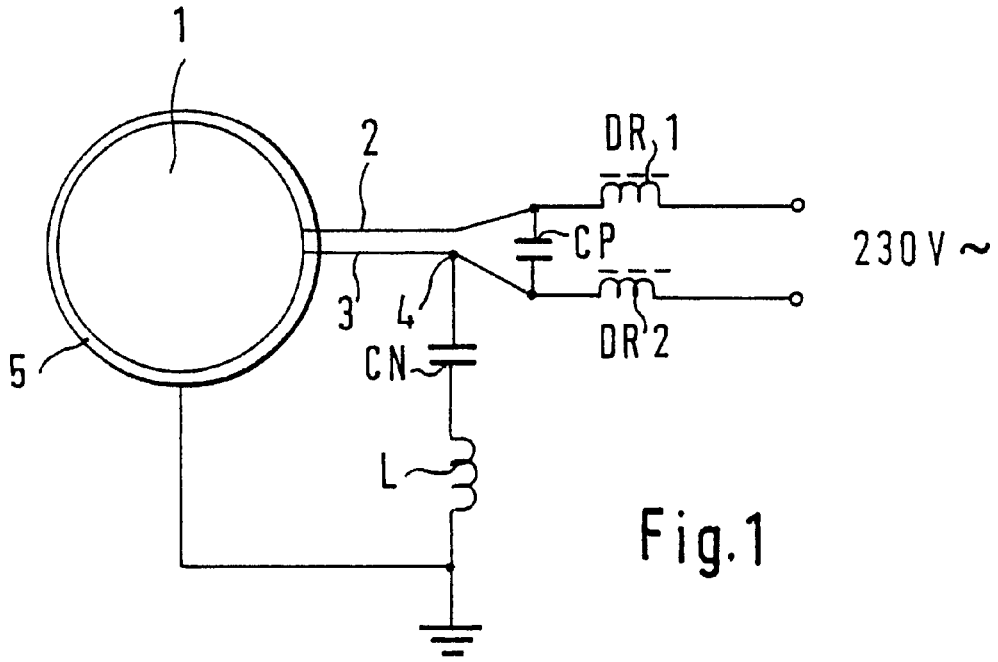
FIG. 1 is a circuit diagram of a pot detection apparatus according to the invention.

A pot detection apparatus has a resistance heating element 1 disposed under an electrically heated hotplate or hob (see FIG. 1). The resistance heating element 1 is connected by way of two lines 2 and 3 to an electrical heating voltage supply with 230 volts alternating current. Two inductors DR1 and DR2 are connected into the lines 2 and 3. They have a low impedance for the low-frequency heating voltage (50 or 60 Hz), and therefore they allow the heating current to flow virtually unimpededly therethrough. Connected to the line 3 at the branch point 4 by way of a separating capacitor CN is a coil L which is connected on the other hand to the housing 5 and to earth. Accordingly the resistance heating element 1 or its capacitance form a resonant circuit, in relation to the earthed housing 5, the separating capacitor CN, the coil L and earth.

The separating capacitor CN has a very high impedance for low frequencies but in contrast a very low impedance for high frequencies. In that way it prevents the low-frequency 230 volt supply voltage being short-circuited to earth. On the other hand, it allows high-frequency currents as occur in such resonant circuits to pass virtually unimpededly. The separating capacitor CN therefore effectively separates the resonant circuit from the heating circuit.

The inductors DR1 and DR2 have a high impedance for the high frequencies of the resonant circuit, so that these high frequencies cannot pass into the mains supply network.

A capacitor CP is connected between the lines 2 and 3, on the side of the inductors DR1 and DR2, which is remote from the supply voltage. The capacitor CP again has a very high impedance for the low-frequency supply voltage, that is to say it does not allow the heating current to pass; however, for high frequencies (that is to say for those of the resonant circuit) it has a very low impedance, and accordingly allows them to pass unimpededly. The interposition of the capacitor CP provides that both terminals of the resistance heating element 1 for the high frequencies of the resonant circuit are at the same potential and in that way the entire surface of the heating element 1 can be used as a capacitance-forming capacitor surface.

Figure 2:
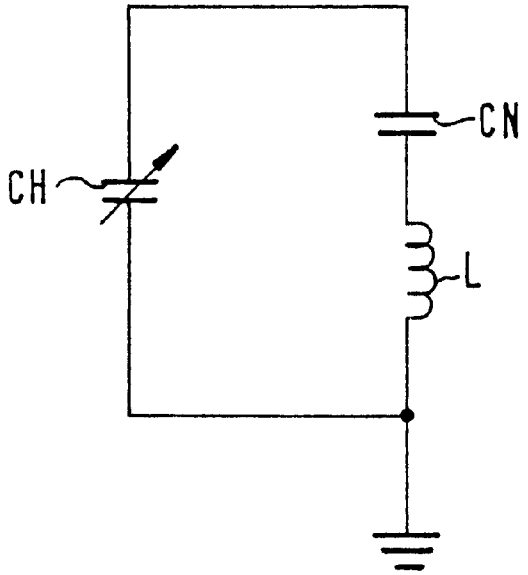
FIG. 2 is an equivalent circuit diagram of the resonant circuit of FIG. 1.

FIG. 2 shows an equivalent circuit diagram of the resonant circuit illustrated in FIG. 1 which, as mentioned above, is separated from the low-frequency heating circuit. CH indicates the capacitance of the heating element 1 in relation to earth. As will be described in greater detail hereinafter, that capacitance CH changes when a cooking pot 6 is put on the hotplate. The resonance frequency of the resonant circuit also changes with that change in capacitance of CH.

Figure 3:
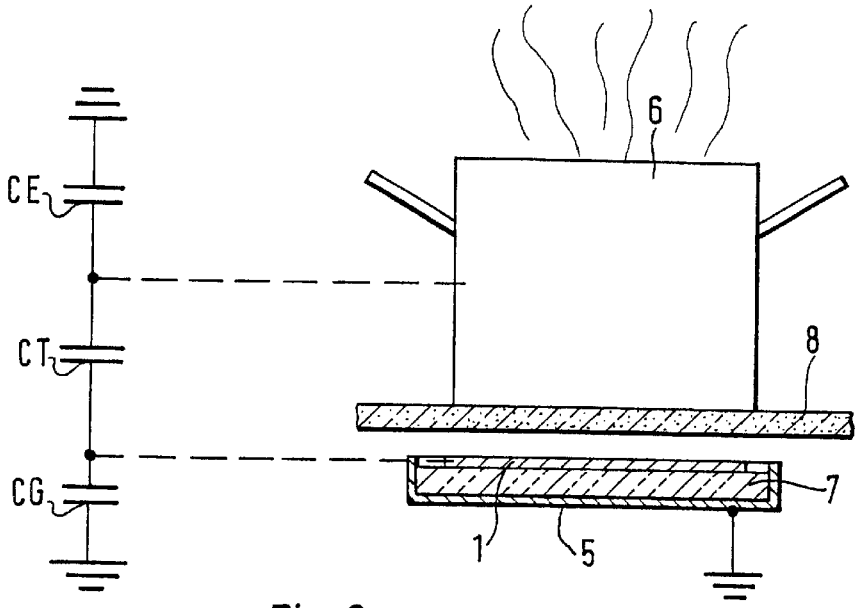
FIG. 3 is a diagrammatic view showing the principle involved in ascertaining the various capacitances.

FIG. 3 diagrammatically shows the way in which the capacitance CH of the resistance heating element 1 in relation to earth is made up. The heating element 1 is disposed, embedded in an insulating layer 7, in the housing 5. Disposed above the heating element 1 is a glass ceramic plate 8 or hob on which the cooking pot 6 stands. The resistance heating element 1 now has on the one hand a capacitance in relation to the earthed housing 5, that is to say in relation to earth. That capacitance is identified by CG. On the other hand however, the heating element 1 also has a capacitance CT in relation to the cooking pot 6. The cooking pot 6 in turn also has a capacitance in relation to earth, which is identified by CE.

Figure 4:
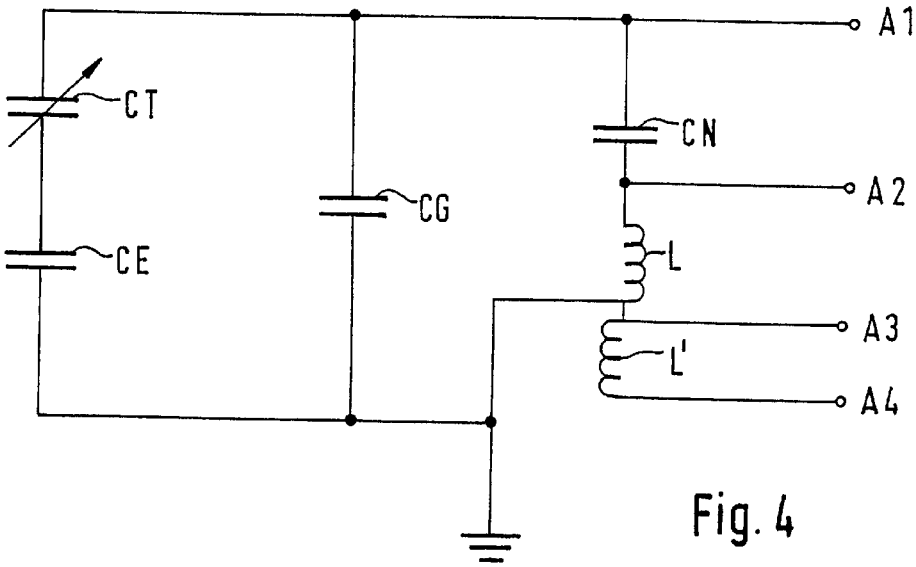
FIG. 4 shows an enlarged equivalent circuit diagram of the resonant circuit of FIG. 2.

FIG. 4 shows the equivalent circuit diagram of the resonant circuit, wherein the capacitances CG, CT and CE in FIG. 3 replace the capacitance CH in FIG. 2. It will now also be clear here why CH is a variable capacitance: if the cooking pot 6 is taken off the hotplate or is even only laterally displaced on the glass ceramic plate 8, the capacitance CT between the resistance heating element 1 and the cooking pot 6 changes. Accordingly therefore CT is the capacitance which provides for a variation in the total capacitance CH between the heating element 1 and earth when a cooking pot 6 is set down or taken away, and thus a change in the resonance frequency of the resonant circuit.

FIG. 4 also shows a number of possible ways in which the resonance frequency of the resonant circuit can be detected by an evaluation unit. Thus, the evaluation unit (not shown) can take off the voltage in the resonant circuit at the connecting points A1 or A2 (in each case in relation to earth) or between the points A3 and A4. The terminals A3 and A4 are connected to the two ends of a coil L' which is coupled to the coil L of the resonant circuit. That provides for transmission of the oscillation, that is to say the frequency of the resonant circuit, to the evaluation unit, with at the same time galvanic separation.

Evaluation of the signals communicated in that way in the evaluation unit is effected in accordance with the general state of the art. It is possible in this case to determine the respective frequency of the resonant circuit, by a procedure whereby for example the oscillations are counted in a given period of time. It is however also possible to envisage using differential methods which involve directly detecting when the resonant circuit is detuned by virtue of a cooking pot 6 being put on the hotplate, being displaced thereon, or being removed therefrom. By means of the magnitude of the change in frequency of the resonant circuit, it is possible to detect in the evaluation unit how large the cooking vessel standing on the hotplate is, or how far a cooking vessel has been pushed onto the hotplate or has been pulled off the hotplate.

In the case of multi-circuit heating elements, the respective heating circuit can be used as its own specific sensor and can thus ascertain the size of the pot disposed on the hotplate. It is however also possible for a plurality of heating elements which are separated from the respective heating voltage supply by way of separating capacitors to be connected together to form a capacitive sensor. In this case the size of the pot disposed on the hotplate is ascertained by virtue of the magnitude of the change in frequency in the resonant circuit.

After detection of the circumstances of the hotplate, the evaluation unit sends suitable signals to a control unit for the hotplate, which thereupon for example switches off the heating if there is no cooking vessel on the hotplate, which switches on only the inner heating circuit when a small pot is present on the hotplate, which switches on both heating circuits when a large pot is present, or which also shuts down the heating when the cooking vessel has been pushed too far away from a central position on the hotplate. If required the control unit can also be set in such a way that it ignores the signals from the pot detection evaluation unit and regulates the heating arrangement solely on the basis of predetermined setting values.

What is claimed is:

1. Apparatus for detecting the presence and/or the size of a cooking vessel on an electrical hotplate comprising an electrical resistance heating element, wherein the electrical resistance heating element is one electrode and the cooking vessel is the other electrode of two electrodes of a capacitor which serves as a capacitive sensor for detecting the presence and/or the size of the cooking vessel on the hotplate, by determining a change of capacitance of the capacitive sensor.

2. Apparatus according to claim 1, characterised in that the capacitance of the resistance heating element in relation to a reference potential, preferably ground, is connected into an electrical resonant circuit whose resonance frequency is detected by an evaluation unit, whereby the presence and/or the size of a cooking vessel on the hotplate can be ascertained.

3. Apparatus according to claim 2, characterised in that the resistance heating element is connected to a heating voltage supply by an electrical switching means, preferably inductors, and is connected into the electrical resonant circuit by a further electrical switching means, preferably a separating capacitor.

4. Apparatus according to claim 3, characterised in that the resonant circuit includes the electrical resistance heating element, the separating capacitor, an inductive element, preferably a coil, and the reference potential.

5. Apparatus according to claim 1, characterised in that a capacitor is connected across the electrical resistance heating element.

6. Apparatus according to claim 1, characterised by multicircuit hotplates which include a plurality of resonant circuits.

7. Apparatus according to claim 1, characterised in that the hotplate comprises ceramic or glass ceramic.

8. Apparatus according to claim 1, characterised in that the electrical resistance heating element comprises a radiant heating body, a foil heating element or a heating path or a heating layer disposed on a support.

9. Apparatus according to claim 1, characterised in that the electrical resistance heating element has line windings or a flat band.

10. Apparatus according to claim 2, characterised in that on the basis of the change in the resonance frequency of the resonant circuit, the size of a cooking vessel on the hotplate or the extent to which the hotplate is covered by the cooking vessel is detected by the evaluation unit.

* * * * *